United States Patent [19]

Calder

[11] Patent Number: 4,537,355

[45] Date of Patent: Aug. 27, 1985

[54] SPRAY TIP

[75] Inventor: Oliver J. Calder, Orange, Calif.

[73] Assignee: Phyllis Graham, Orange, Calif.

[21] Appl. No.: 575,153

[22] Filed: Jan. 30, 1984

Related U.S. Application Data

[63] Continuation of Ser. No. 457,919, Jan. 14, 1983, Pat. No. 4,484,707, which is a continuation-in-part of Ser. No. 442,525, Nov. 18, 1982, Pat. No. 4,483,481, which is a continuation of Ser. No. 165,247, Jul. 2, 1980, abandoned.

[51] Int. Cl.[3] ..... B05B 15/02

[52] U.S. Cl. ..... 239/119; 239/288.3; 239/600; 277/235 A

[58] Field of Search ..... 239/119, 288, 288.3, 239/600, DIG. 22; 251/312, 368; 277/235 R, 235 A, 188 A

[56] References Cited

U.S. PATENT DOCUMENTS

| | | | |
|---|---|---|---|
| 3,202,360 | 8/1965 | O'Brien | 239/119 |
| 3,627,334 | 12/1971 | Reddy | 277/235 A |
| 3,709,256 | 1/1973 | Gore et al. | 251/312 |
| 3,918,495 | 11/1975 | Abrahams | 251/368 |
| 4,116,386 | 9/1978 | Calder | 239/119 |
| 4,165,836 | 8/1979 | Eull | 239/119 |
| 4,256,260 | 3/1981 | Piggott | 239/119 |

FOREIGN PATENT DOCUMENTS

| | | | |
|---|---|---|---|
| 1114598 | 12/1981 | Canada | 239/288 |
| 1152441 | 2/1958 | France | 251/312 |

*Primary Examiner*—Jeffrey V. Nase
*Assistant Examiner*—Michael J. Forman
*Attorney, Agent, or Firm*—Robert E. Strauss

[57] ABSTRACT

There is disclosed an improved spray tip particularly suited for airless pressured spraying utilizing a spray orifice member in a removable turret member that can be rotated to reverse the orifice for cleaning. The design permits rapid exchange of the turret member, permitting quick substitution of different sized orifice members. The turret member is sealed in the assembly with a thin plastic seal and a seal support which is compressed in the assembly by hand tightening. The seal and seal support are restrained in the spray tip against dislodgement during removal of the turret member. A tee seal is provided which has a flange of reduced diameter which seats against the end of the spray gun to insure complete sealing with hand tightening of the retainer nut. The spray tip also includes a low friction bearing washer between its housing and retaining nut which, in cooperation with the tee seal, permits rotation of the spray tip without loosening its retainer nut.

6 Claims, 6 Drawing Figures

SPRAY TIP

REFERENCE TO RELATED APPLICATIONS

This application is a continuation of copending application, Ser. No. 457,919, filed Jan. 14, 1983, now U.S. Pat. No. 4,484,707, issued Nov. 27, 1984, which is a continuation-in-part of application Ser. No. 442,525, filed Nov. 18, 1982, now U.S. Pat. No. 4,483,481, issued Nov. 20, 1984, which is a continuation of application Ser. No. 165,247, filed July 2, 1980, now abandoned.

BACKGROUND OF THE INVENTION

In my prior U.S. Pat. No. 3,831,862, I disclosed a spray tip assembly in which the spray tip orifice is mounted in a removable and reversible sleeve which is secured in the housing with a sliding pin interlock. This construction requires loosening of the body from its adapter to reverse and/or replace the spray tip orifice.

In my prior U.S. Pat. No. 4,116,386, I disclosed a spray tip assembly in which the spray tip orifice is mounted in a cylindrical turret member which can be rotated in the housing to reverse the orifice member for cleaning. This construction employs a solid, resilient plastic seal which has a cylindrical surface of the turret member.

A recently issued U.S. Pat. No. 4,165,836, discloses that solid plastic seals experience excessive wear and suggest that an entirely metal seal be used to provide metal-to-metal contact between the seal and turret member. Experience with devices of this invention, however, reveals that the metal seal is not effective with low viscosity liquids which leak from the assembly under the high pressures used in airless spraying, and in my parent, copending application, I disclose that this difficulty can be avoided by using a thin layer Teflon seal on a metal seal support.

In a typical spray application, it is frequently necessary to substitute different size orifice members, and this requires interchanging the turret member. Heretofore, the various seals and seal supports dislodged from the spray tips when the turret members were removed, complicating reassembly. It is desirable that the spray tip permit a simple removal and interchanging of the spray orifice without disassembly and without dislodgement of the other parts of the spray tip.

BRIEF STATEMENT OF THE INVENTION

This invention comprises a spray tip having a housing with a longitudinal through passageway and a cylindrical through bore orthogonal to and intersecting the through passageway. The through passageway is non-cylindrical and preferably is square in cross-section. A cylindrical turret member, which has a transverse through bore in which is seated an orifice member, is seated in the cylindrical through bore. The turret member has a dependent handle and an annular prong which is captured between abutment stops on the housing body. A removable spray guard fits over the spray tip housing with an aperture which can be aligned with its cylindrical through bore to receive the turret member. A radial notch in this aperture receives the turret member prong to permit removal of the turret member and the turret member is axially captured in the assembly by its prong which is restrained between the spray guard and housing body. The longitudinal through passageway of the housing body receives a hard surface seal support having a permanently bonded, thin-film plastic seal. The seal and seal support have a central through passageway and a cylindrically concave sealing surface which seats against the turret member which, preferably, is also coated with a permanently bonded, thin-film plastic seal. The seal support and its seal have a cross-section mating with the non-cylindrical through passageway thereby maintaining their cylindrically concave surfaces aligned with the cylindrical through bore when the turret member is removed. The thin-film seals have thicknesses from about 0.001 to about 0.1 inch and are formed of a low frictional plastic such as Teflon, thus insuring minimal frictional resistance to rotation of the turret member.

The invention also includes a retainer cap nut and a tee seal for axially compressing the seal support and seal against the cylindrical surface of the turret member thus firmly sealing the assembly. Preferably the tee seal has a boss which is received in the rear face of the seal support. Although these parts when new fit loosely, after use, the internal pressure of the liquid expands the boss into a frictional fit that resists dislodgement of the seal support when the turret member is removed.

The retainer cap and nut and spray tip housing are interconnected by a sleeve retainer having a low frictional bearing washer which permits hand rotation of the spray tip while the seals are compressed in the assembly to the spray gun. The upstream face of the tee seal which seats against the end of the spray gun has a reduced diameter to facilitate sealing with hand tightening of the retainer nut and the tee seal is of sufficient length that it does not seal against the upstream face of the adapter between the housing and the retainer nut. This permits rotation of the spray tip on the gun to change the spray pattern between vertical and horizontal positions without loosening of the retainer cap nut. The turret member can be removed simply by loosening the cap nut to release the seal compression, aligning the prong of the turret member with the notch in the aperture of the spray guard and retraction of the turret member. A substitute turret member can be inserted and the cap nut tightened, completing the substitution in a few seconds.

BRIEF DESCRIPTION OF THE DRAWINGS

The invention will be described with reference to the figures of which:

FIG. 5 is an exploded view of the housing body, retainer nut and washer.

DESCRIPTION OF THE PREFERRED EMBODIMENTS

Figure 1:
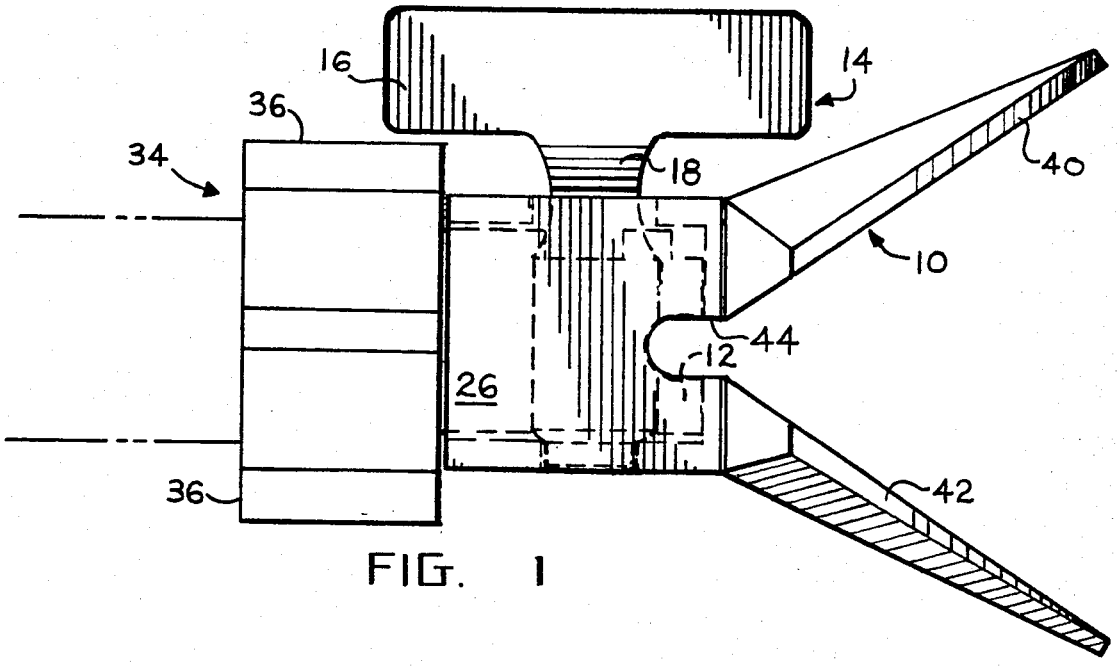
FIG. 1 is an elevational view of the spray tip of the invention.
Figure 2:
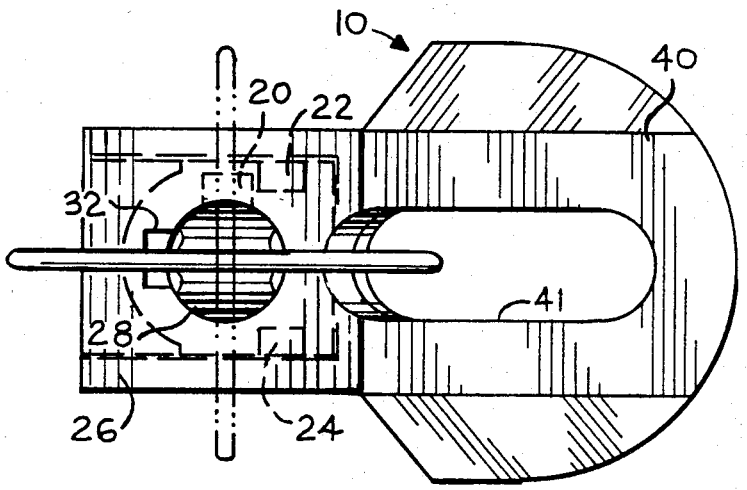
FIG. 2 is a top view of the spray tip of the invention.
Figure 3:
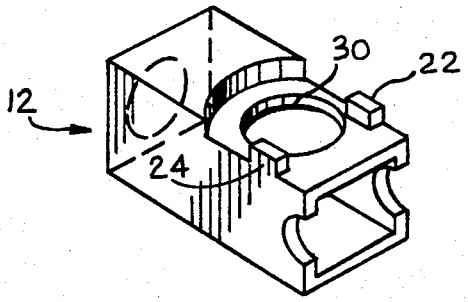
FIG. 3 is a perspective view of the spray tip housing body.

Referring now to FIGS. 1 and 2, the invention is shown with a spray guard 10 mounted on a housing body 12 which supports a turret member 14. The turret member has a dependent handle 16 on shaft 18 which extends to a cylindrical turret member described in detail hereinafter. As shown in FIG. 2, the turret member 14 has an annular prong 20 and body 12 has opposite abutment stops 22 and 24, also shown in FIG. 3. The spray guard body 26 has an aperture 28 which aligns with the cylindrical through bore 30 of housing body 12 to secure the turret member 14. The aperture 28 has a notch 32 which permits extraction of the turret member when the latter is rotated to align prong 20 beneath notch 32.

The spray tip assembly is retained on the externally threaded barrel of a spray gun by the retainer cap nut 34. Tightening of this nut on the threaded barrel of the spray gun axially compresses the internal seals of the assembly in a manner described in greater detail hereinafter. For this purpose, lugs 36 are provided to permit hand tightening of cap nut 34.

Figure 4:
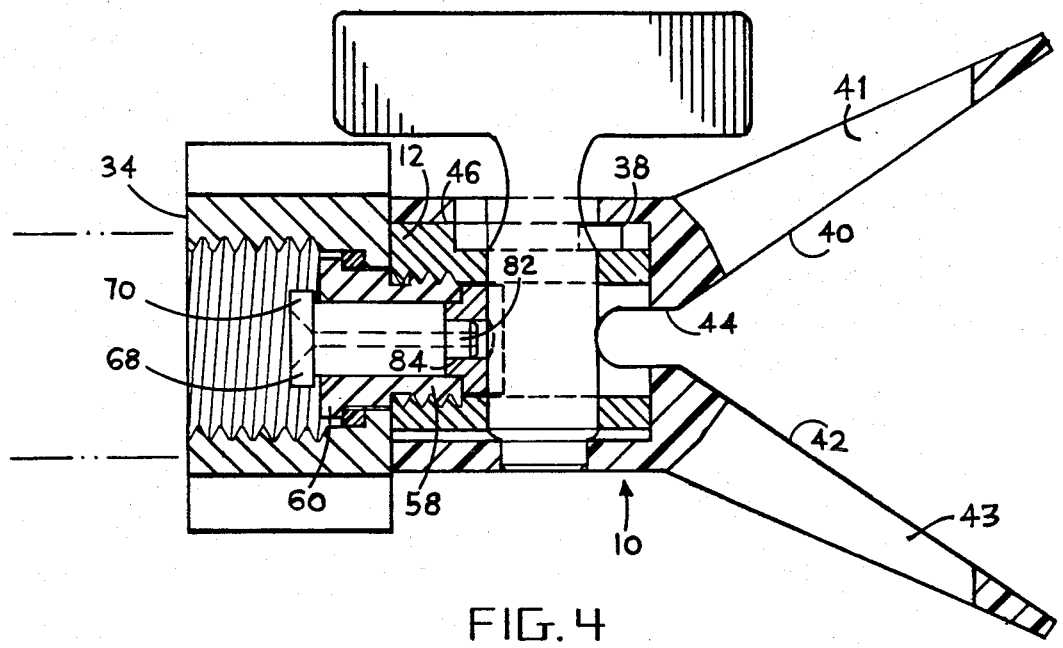
FIG. 4 is an elevational sectional view of the spray tip.

Referring now to FIG. 4, the spray tip assembly is shown in greater detail. As there illustrated, the spray guard 10 has a square cross-sectional body 26 with a central cavity 38 that fits over the square body 12 of the spray tip. The spray guard 10 has a pair of outwardly diverging wings 40 and 42 which are generally trapezoidal in shape as apparent from FIGS. 1 and 2. At the apex or intersection of wings 40 and 42, the spray gun has a slot 44 to provide clearance for the spray discharge from the spray tip. Each of the outwardly diverging wings 40 and 42 have a longitudinal, central, through slot 41 and 43. These slots are also shown in FIG. 2. As illustrated in the preferred embodiment, the slots 41 and 43 are narrow and extend substantially the entire length of wings 40 and 42.

The body 12 of the spray tip housing has a longitudinal chamber 46 of non-circular, preferably square, cross-section. The end wall 48 is bored at 50 (see FIG. 5). The housing body 12 also has a cylindrical bore 30 orthogonal to and intersecting the longitudinal chamber 46 and this cylindrical bore 30 receives the cylindrical turret member 14. The latter has a transverse bore 52 which is counterbored at 54 to receive a spray tip orifice member 56. The orifice member 56 is firmly seated against the annular shoulder between bore 54 and counterbore 56 and is secured by a sleeve which is pressed into counterbore 56. Bore 54 should be of sufficient length that the orifice tip 56 does not project beyond the cylindrical surface of turret member 14.

As shown in FIGS. 4 and 5, the housing body 12 is secured to the retaining nut 34 by sleeve 58 which has an annular flange 60 that is received within the retainer nut 34. The assembly is permanently secured by threading sleeve 58 into internally threaded bore 50 in body 12. The sleeve 58 has a threaded end with an open groove 59 and an annular shoulder 61. The bore 50 also has a square shoulder, i.e., is unchamfered, to provide an abutment stop which precisely controls the axial positioning of sleeve 58 in body 12. A low frictional bearing washer 62 is captured between the annular rim 64 of cap nut 34 and flange 60 of sleeve 58 and provides the only frictional resistance between the retainer nut 34 and the assembly of body 12 and sleeve 58, when the retainer nut 34 is tightened.

The spray tip has a solid plastic tee seal 68 which has an annular flange 70 that overlies the face of flange 60 of sleeve 58. The tee seal has a sleeve body 72 that extends through sleeve 58 and is received against the narrow edge 74 of seal support 76. The latter has a central bore 78 which is in alignment with the through passageway 80 of the tee seal 68. The forward end of seal support 76 has a small diameter boss 82 which is received in counterbore 84 in the rear face of seal support 76. When these parts are new, boss 82 fits loosely in counterbore 84, however, after use, the liquid pressure expands the boss 82 sufficiently that is retained in counterbore 84 in a friction fit which resists dislodgement of seal support 76 when the turret member 14 is removed from the assembly such as during replacement or substitution of the turret member.

Figure 6:
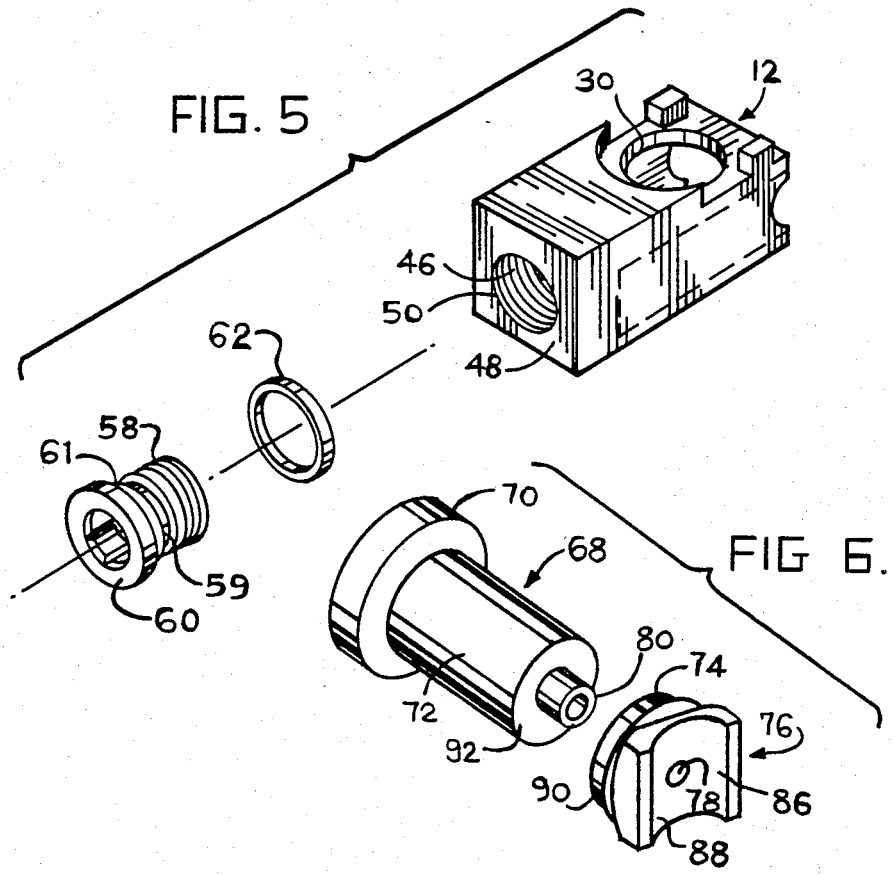
FIG. 6 is a perspective view of the seal support, seal and tee seal used in the invention.
Figure 7:
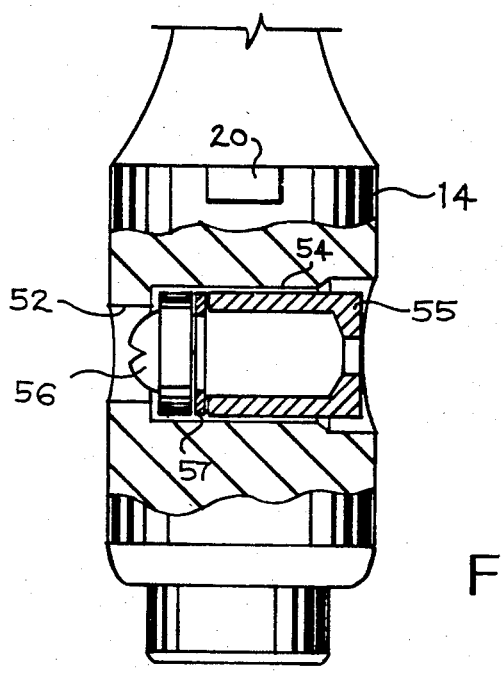

The constructions and shapes of the seal support, its thin layer seal, and the tee seal are described in greater detail with reference to FIG. 6. Referring now to FIG. 6, the forward, sealing face 86 of the seal and seal support has a cylindrical concavity with a central bore 78. The thin layer seal 88 is permanently bonded to the forward face of seal support 76. In the preferred embodiment, the turret member is also coated with a permanently bonded thin-layer seal of similar thickness and material to that of the thin-layer seal 88. This provides for maximum ease of turing of the turret member.

The seal support 76 and seal 88 have a square face, to fit the square cross-sectional chamber 46 of body 12. The rear face of seal support 76 has an externally beveled boss 90 to provide a narrow edge 74 which seats against the forward end face 92 of the plastic tee seal 68. The assembly of the spray tip on a spray gun and tightening of the retainer cap nut 34 on the threaded barrel of the spray gun applies an axial compression to the seal assembly. The end of the spray gun barrel is forcefully compressed on the face of flange 70 of the tee seal 68. As apparent from FIG. 4, flange 70 is substantially of lesser diameter than the internal diameter of the threaded bore of retainer nut 34. The lesser diameter of this flange insures adequate sealing even with hand tightening of the retainer nut 34 since the sealing surface is maintained at a minimum to obtain maximum sealing pressure, in psi, against flange 70. In the illustrated, preferred embodiment, the diameter of the sealing flange 70 is from 40 to about 60% of the internal diameter of retainer nut 34.

It is also apparent from FIG. 4 that the sleeve body 72 of the tee seal 68 is sufficiently long to position flange 70 slightly past the face of annular flange 60. In the preferred embodiment, this distance is approximately 0.002–0.005 inch and is sufficient to avoid contact between the opposed faces of flanges 60 and 70. This insures that the tee seal will be compressed when retainer nut 34 is hand tightened and that this compressive force will be transmitted through the sleeve 72 and against narrow edge 74 on the rear face of seal support 76. It also insures that there is no frictional drag between the flanges 60 and 70 opposing rotation of the spray tip. The compressive force exerted on the assembly by tightening of the retainer nut compresses the thin layer seal 88 against the cylindrical turret member 18, insuring a secure sealing of the assembly. Since the thin layer seal 88 is preferably formed of a plastic having a relatively low coefficient of friction, e.g., Delrin, Teflon, etc., the turret member can be readily rotated by hand to reverse the position of the spray orifice in the assembly without releasing the seal compression, and the seal remains effective even after many repeated movements of the turret member. The thin layer seals such as 88 or the thin-layer seal on the turret member are also sufficiently thin, e.g., from about 0.001 to 0.1 inch, preferably from about 0.001 to about 0.005 inch, that no seizure of the turret member is experienced even upon prolonged periods of compression.

The thin layer seals such as 88 is permanently bonded to the seal support 76, or to the turret member. For this purpose, a thin layer of Teflon powder is applied as a coating over the cylindrically concave surface 86 of seal support 76 and is heat treated to obtain a baked resin coating of the specified thickness. Preferably, the turret member is treated in a similar manner to provide a permanently bonded thin-layer seal about its cylindrical surface.

The spray tip of this invention is provided with a plurality of interchangeable turret members with varied sizes of orifice tips to permit the user to switch turret members whenever it is desired to change the volume or spread of the fan spray. The orifice tips can be provided in sizes from about 0.005 to about 0.075 inch in any varied increments, preferably in increments from about 0.001 to 0.003 inch. These orifice tips will provide a fan spray with a width from 2 to about 22 inches in approximately 2 inch increments.

Because the seal and seal support are indexed in the tip housing 12 against rotation, the cylindrically concave face 86 of these members remains in axial alignment with the cylindrical bore 30 while the turret member is removed or replaced. Also, since the seal support 76 is restrained by its frictional fit with the boss 80 of tee seal 68, it can not move forward when the turret member is removed. Instead, it resists dislodgement and remains in place to insure that the turret member, or a replacement turret member, can be quickly inserted without need to reposition the seal support.

The invention provides a number of definite advantages over prior spray tips. The plastic seal of the invention tightly seals and minimizes leakage even with low viscosity liquids. The metal or rigid seal support, however, firmly supports the seal and insures that the seal does not seize the turret member and prevent its rotation by hand. The turret member is easily removable from the spray tip simply by loosening retainer cap nut 30 and rotating the turret member to align its prong with the notch of the spray guard. When the turret member is removed, the seal and seal support remain in place to permit rapid replacement of the turret member. The retainer cap nut can be tightened and loosened by hand and the spray tip can be rotated on the spray gun without loosening the cap nut.

The seal support is preferably formed of metal, although any other hard and durable material can be used such as ceramic, graphite, etc. Preferably, the seal support and the turret member are formed of a corrosion resistant metal such as stainless steel.

The invention has been described with reference to the illustrated and presently preferred embodiment. It is not intended that the invention be unduly limited by this disclosure of the presently preferred embodiment. Instead, it is intended that the invention be defined by the means, and their obvious equivalents, set forth in the following claims.

What is claimed is:

1. A spray tip comprising:

a housing having a longitudinal through passageway and an intersecting orthogonal cylindrical bore;

a cylindrical turret member rotatably seated in said intersecting cylindrical bore and having a transverse bore in alignment with said through passageway;

a spray tip orifice member mounted in said transverse bore;

a hard surface seal support received in said longitudinal through passageway and having a central through passage and a cylindrical concave seal support surface facing said turret member;

a thin layer seal supported by said cylindrical concave seal support surface and seated against said turret member and formed of a plastic having a low coefficient of friction and having a uniform thickness from about 0.001 to about 0.1 inch, sufficient to resiliently seal, but insufficient to sieze said turret member when compressively loaded; and a retainer cap nut on said housing to secure said housing to a spray gun and a plastic tee seal received within said nut for capture between the end of said spray gun and said seal support, thereby providing compression means for axially compressing said seal support and seal sufficiently against said turret member to prevent leaking whereby said turret member can be readily rotated by hand to reverse the position of the spray orifice in the assembly without releasing said compression means.

2. The spray tip of claim 1 wherein said thin layer seal is formed of Teflon which is permanently bonded to the surface of said seal support.

3. The spray tip of claim 1 wherein said thin layer seal is formed of Teflon permanently bonded to the outer cylindrical surface of said turret member.

4. The spray tip of claim 1 wherein said thin layer seal is an interchangeable seal of Teflon.

5. The spray tip of claim 1 wherein said turret member has an integrally formed, dependent handle.

6. The spray tip of claim 5 including a spray guard having a pair of outwardly diverging wings dependent from a spray guard body having a central cavity receiving said housing with a central longitudinal through slot in each of said outwardly diverging wings extending substantially the length thereof.

* * * * *